United States Patent [19]

Debortoli et al.

[11] Patent Number: 4,927,375

[45] Date of Patent: May 22, 1990

[54] ELECTRICAL CONNECTOR FOR ELECTRICAL CONNECTION TO INSULATION DISPLACEMENT TERMINALS

[75] Inventors: George Debortoli, Ottawa; Alex G. Cristescu, Montreal, both of Canada

[73] Assignee: Northern Telecom Limited, Montreal, Canada

[21] Appl. No.: 314,028

[22] Filed: Feb. 23, 1989

[51] Int. Cl.[5] ..... H01R 13/58; H01R 13/627

[52] U.S. Cl. ..... 439/357; 439/466

[58] Field of Search ..... 439/465–468, 439/696, 695, 694, 353, 357

[56] References Cited

U.S. PATENT DOCUMENTS 3,636,495 1/1972 Forsyth, Jr. ..... 439/466
4,618,202 10/1986 Libregts et al. ..... 439/466
4,735,574 4/1988 Beaulieu et al. ..... 439/43
4,755,151 7/1988 Beaulien et al. ..... 439/395

*Primary Examiner*—Gary F. Paumen
*Attorney, Agent, or Firm*—R. J. Austin

[57] ABSTRACT

An electrical connector to connect to an insulation displacement terminal in which a housing body has integral latches to releasably hold the body to a connector. A chamber within the body has an entrance for insulated conductor which may form part of a cable. One side of the body has an access opening to the chamber and to a terminal position for the conductor at which the conductor is connectable to an electrical contact blade extending from the body. A conductor strain relief is also accessible through the opening and a cover is locatable in snap-on manner over the opening. Preferably, the cover covers the strain relief to prevent removal of the conductor and the strain relief is integral with the body.

13 Claims, 3 Drawing Sheets

ELECTRICAL CONNECTOR FOR ELECTRICAL CONNECTION TO INSULATION DISPLACEMENT TERMINALS

BACKGROUND OF THE INVENTION

This invention relates to an electrical connector for electrical connection to insulation displacement terminals. Insulation displacement terminal arrays are commonly used in distribution frames for the distribution of electrical wiring to access points in terminals within a customer's premises from an incoming telecommunications cable. The distribution frame may be of a construction or frame referred to as "module" in U.S. Pat. No. 4,278,315, granted July 14, 1981 in the name of B.T. Osborne. Distribution frames have mounted therein a plurality of terminal assemblies normally of a construction referred to as "cross-connect connectors" in that each assembly comprises a dielectric terminal carrier with two spaced arrays of insulation displacement terminals carried by the carrier. The terminals of one row are interconnected electrically and in desired fashion with those of the other row through the dielectric carrier. A construction of cross-connect connector may be as referred to as "connector block" in U.S. Pat. No. 4,295,703, granted Oct. 20, 1981 in the name of B. T. Osborne.

It is frequently necessary to electrically connect each of a selected pair of terminals of a terminal array of one cross-connect connector to a respective terminal of a corresponding pair of terminals of an array of an adjacent cross-connect connector. This is typically done by connecting a bridging link in the form of a flexible wire to each of the selected pair of terminals, and bridging each wire to a respective one of the corresponding pair of terminals. This operation requires separate insertion of each end of each wire with an insertion tool and trimming each wire to length.

Because the wire cannot generally be reused, the above steps must be repeated each time such a connection is interrupted for test purposes. Moreover, the size and density of the terminal arrays make slight misalignment of the connecting wires difficult to avoid and detect. Such misalignments result in wrongly made connections.

In Canadian Patent Application No. 536,028, filed Apr. 30, 1987 (U.S. Pat. Application No. 045,354, filed May 4, 1987, now U.S. Pat. No. 4,755,151) in the name of L.A.J. Beaulieu, a bridging link is described which provides error free electrical connection between terminals of two arrays. In the construction described in this patent application, spaced-apart electrical contact members are held by a dielectric body, the contact members being spaced a distance apart for engagement within insulation displacement terminals selected from two adjacent rows. The contact members are interconnected through the dielectric body to enable electrical contact to be made between the two insulation displacement terminals. In another Canadian Patent Application No. 536,027 filed Apr. 30, 1987 (U.S. Pat. Application Ser. No. 045,337 filed May 4, 1987, now U.S. Pat. No. 4,735,574) in the name of L.A.J. Beaulieu, an electrical connector is described which may either be a bridging link to extend between terminals of two adjacent arrays of terminals, or the connector may be a patch cord. A patch cord's construction is one having a connector element at each end of an insulated conductor wire, so that the two connectors may be connected to a selected terminal of one array and any particular terminal of another array upon a distribution frame. In this patent application, a latching means is described for use with each of the connectors for holding the connector in position upon a terminal assembly which may be in the form of a cross-connect connector.

SUMMARY OF THE INVENTION

The present invention seeks to provide an electrical connector which may be a bridging link or part of a patch cord, and which is simple in construction and easy to manufacture.

Accordingly, the present invention provides an electrical connector for electrical connection to an insulation displacement terminal of a terminal assembly, the connector comprising:- a dielectric housing body having an integral latch means extending outwardly from one side of the body for releasably latching the connector in a mounting position on the terminal assembly, the housing body defining a chamber with an entrance to the chamber for an insulated conductor, a conductor terminal position within the body for connecting the conductor to the contact blade, and an opening at another side of the body for access to the chamber and the terminal position; an electrical contact blade carried by and extending from said one side of the body the contact blade also extending to the terminal position, and a conductor insulation strain relief means; and a cover for positioning over and closing the opening, the cover locatable to close the opening in snap-on fashion.

The electrical connector of the present invention is easy to produce by simple molding of the body and cover. The strain relief means may be provided by a passage formed by the body, the passage having an open side which opens at the side of the body at which the opening is also provided. With this structure, the insulated conductor may be inserted laterally into the passage and gripped by the body. In a preferred arrangement, the cover when in position mounted upon the body covers the opening to the strain relief passage to prevent removal of the insulated conductor therefrom.

The cover may have a manually grippable projecting portion which extends away from the body so as to enable the connector to be mounted and released from its mating position in simple and easy fashion.

BRIEF DESCRIPTION OF THE DRAWINGS

Embodiments of the invention will now be described, by way of example, with reference to the accompanying drawings, in which.

DESCRIPTION OF EMBODIMENTS

Figure 1:
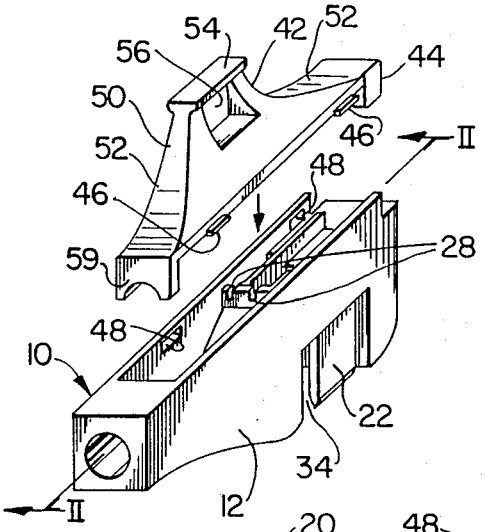
FIG. 1 is an isometric view of an electrical connector according to a first embodiment and showing a cover removed.

As shown in FIG. 1, an electrical connector 10 for forming part of a patch cord comprises a dielectric housing body 12. As is more clearly shown in FIGS. 2 and 3, the dielectric housing body 12 is a single molded one piece dielectric plastics construction which is elongate and defines a chamber 14 which has an opening at one elongate side 16 of the body. The chamber 14 is defined between two walls 18 and terminates short of one end 20, an entrance 21 to the chamber extending through the body to the end 20 for passage of an electrical cable into the body.

Figure 4:
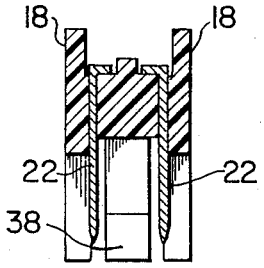
FIG. 4 is a cross-sectional view through the body and taken along line IV—IV in FIG. 2.

A pair of spaced-apart and electrically isolated electrical contact blades 22 are held by the body and extend outwardly from the body from a body side 24 remote from side 16. The contact blades are molded into the body. Each blade is provided with a turned over flange 26 (see particularly FIG. 4) which seats against a surface of the body between the two sidewalls 18, in terminal positions for connection to electrical conductors facing the side 16. The terminal positions are accessible from side 16 of the body and between walls 18.

Figure 2:
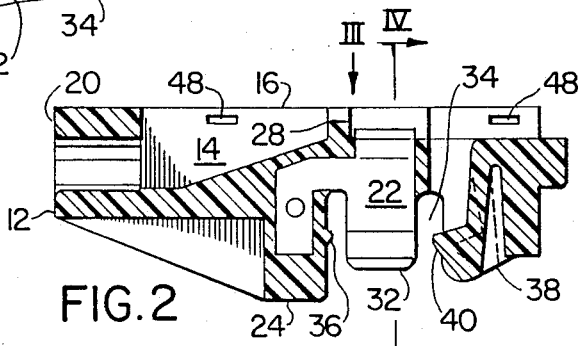
FIG. 2 is to a larger scale than FIG. 1 and is a cross-sectional view along line II—II in FIG. 1 of a body of the connector carrying contact blades.
Figure 3:
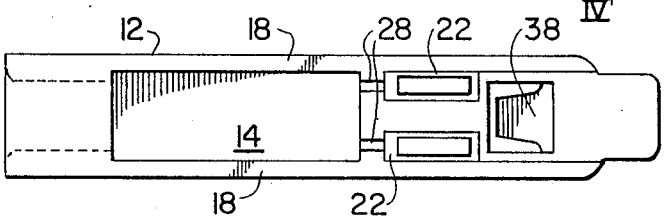
FIG. 3 is a view in the direction of arrow III upon the body of FIG. 2.
Figure 8:
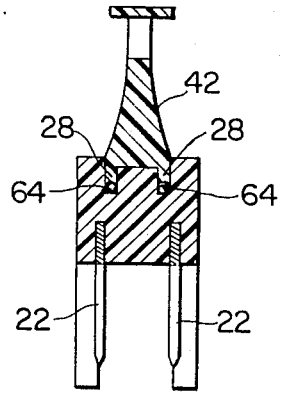
FIG. 8 is a cross-sectional view through the assembled connector and taken along line VIII—VIII in FIG. 6.

The body 12 is provided with insulation strain relief means in the form of two passages 28 formed during molding of the body (FIGS. 2, 3 and 8). These passages 28 lie between the chamber 14 and the terminal positions of the flanges 26 of the blades, and each passage has an open side 30 facing the side 16 to allow access for inserting the insulated conductors laterally into the passages.

Free ends 32 of each of the blades, extend into a recess 34 formed in the side 24 of the body. The recess 34 is provided for receiving one edge of a cross-connect connector as will be described, and into one side surface of the recess extends a tapered projection 36 for locating in a groove of the cross-connect connector to assist in holding the body in mounted position. Projection 36 is opposed by an integral latch means of the body, the latch means being in the form of a cantilever latch 38 which extends across the width of the body and terminates in a head 40 which projects inwardly into the recess 34.

The connector is provided for a cover for positioning over and closing the opening to the chamber 14 and to the terminal positions of the blades 22 and also for closing the open sides 30 of the strain relief passages 28 so as to prevent removal of conductors placed therein.

As shown in FIG. 1, a cover 42 of the connector has a planar base or portion 44 which fits snugly between the two walls 18 so as to completely close the opening. The cover is a snap-fit onto the body and for this purpose is provided with two non-return latches 46 which are receivable within slots 48 extending into the walls 18. The latches are formed so as to allow for mounting of the cover upon the body in a downward direction as shown in FIG. 1, but will prevent its removal upon reception of the latches within the slots 48.

The cover has its planar base or cover portion 44 integrally formed with a manually grippable projecting portion 50 so as to enable the connector to be mounted in and released from its mounting position upon the body 12 with the latches 46 retaining the cover in position. As may be seen from FIG. 1, the projecting portion 50 has sides 52 which converge as they extend away from the base 44, the converging sides provided to prevent snaqqinq of conductor wires extending across the distribution frame during removal of the connector from its mounting position. The outer end of the projecting portion 50 is formed as a flat laterally projecting section 54 with a recess or aperture 56 formed beneath it so as to enable fingers to grip around the section 54 for connector removal. At one end, the cover is formed with a downward projection 59 with a part cylindrical recess extending upwardly into it. The projection 59 is a strain relief projection for a cable jacket as will be described.

Figure 5:
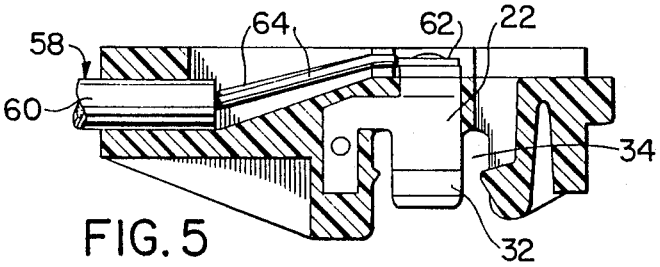
FIG. 5 is a view similar to FIG. 2 and showing insulated conductor inserted into the body.
Figure 6:
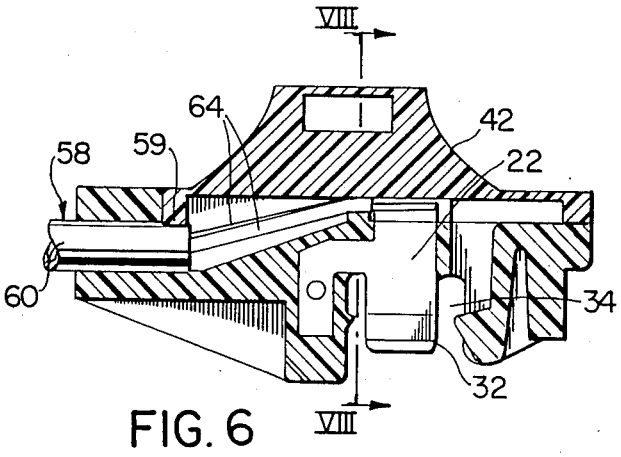
FIG. 6 is a view similar to FIG. 5 and showing a cover added to the body.
Figure 7:
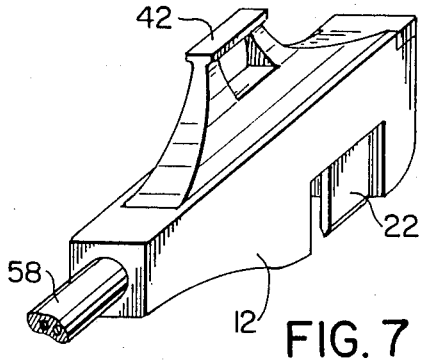
FIG. 7 is a view similar to FIG. 1 showing the connector in assembled position and forming part of a patch cord.

The electrical connector forms one of two identical connectors 10 of a patch cord which also includes an electrical cable 58 (see FIG. 5). The cable 58 comprises a sheath 60 surrounding a pair of electrical conductor wires 62 individually surrounded with insulation 64. As shown by FIG. 5, each end of the cable 58 is joined to one of the connectors 10 (only one of which is shown) by removing an appropriate length of jacket 58 so as to expose the insulated conductors and then passing the exposed ends through the entrance 21 into the chamber 14 with the insulated conductors extending across the chamber. In the assembled condition, exposed ends of the conductors 62 are soldered to the flanges 26 of the two contact blades 22 and insulated parts of the conductors extend through the strain relief passages 28 and across the chamber 14, the end of the jacket 60 being received within the entrance 21. As may be seen, it is a simple operation to connect the cable ends to the two electrical connectors. With one of the blades 22 electrically connected by a corresponding conductor wire 62 with a corresponding contact blade 22 of the other connector, the cover 42 is then placed into position. A downward movement of the cover as indicated in FIG. 1, between the walls 18 of the body will result in the latches 46 being permanently received within the slots 48. FIGS. 6 and 7 show one end of the completed patch cord with the cover in position. FIGS. 6 and 8 clearly show that with the cover 42 in assembled position, the insulated conductors 62 cannot be removed laterally from the strain relief passages 28. As will be noticed, the cable is inserted into the body 12 with an end of the jacket 60 extending into chamber 14. With the cover 42 assembled to the body, the strain relief projection 59 grips the jacket end (FIG. 8) to prevent relative movement of the cable cord connector.

Figure 9:
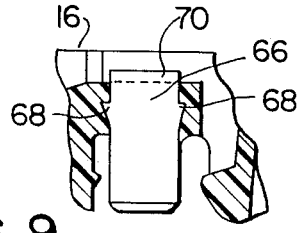
FIG. 9 is a cross-sectional view of parts of a connector forming a modification of the first embodiment and in the same direction as FIG. 2.

The contact blades 22 need not be integrally molded into the body. For instance, in a first modification as shown in FIG. 9, each contact blade 66 is formed with means for holding the blade within the body in a desired operable position. This means comprises two tangs 68 extending outwardly from opposite sides of each contact blade 66, the two tangs becoming embedded into the plastics material of the body during blade insertion from the open side 16 of the body. The blades are so shaped as shown in FIG. 9 to prevent removal of the blades in the return direction. In addition, further movement in the insertion direction of the blades 66 is prevented by the engagement of a flange 70 of each blade with a surface of the body, the flange 70 being similar to the flanges 26 in the first embodiment.

Figure 10:
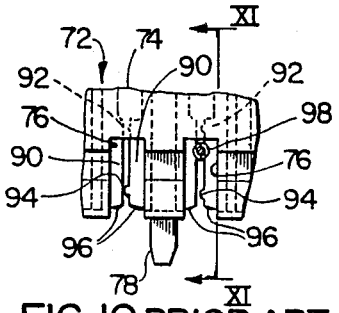
FIG. 10 PRIOR ART
FIG. 10 is a plan view of a prior art crossconnect connector to which the connector of the first embodiment is to be connected.
Figure 11:
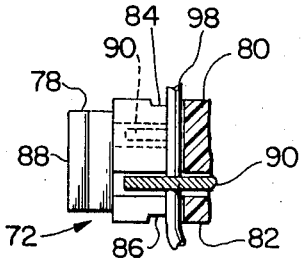
FIG. 11 PRIOR ART
FIG. 11 is a cross-sectional view taken along line XI—XI in FIG. 10 of the cross-connect connector.

It is intended that the patch cord should be mounted with each of the connectors 10 in mounted position secured to a terminal assembly such as a BIX (Registered Trade Mark of Northern Telecom Limited) terminal assembly 72 shown in FIGS. 10 and 11 and commonly used in distribution frames of telephone exchanges. Each terminal assembly 72, commonly referred to as a cross-connect connector, is of the construction described in U.S. Pat. No. 4,295,703 and comprises an elongate dielectrical terminal carrier 74 having a rectilinear array of vertically extending slots 76 provided in two longitudinally extending edges of the terminal carrier. In FIGS. 10 and 11, one edge only of the carrier 74 is shown. The slots 76 are in pairs and a finger 78 projects forwardly between the individual slots of each pair. Upper and lower faces 80 and 82 (FIG. 11) of the carrier 74 include upper and lower longitudinally extending recesses 84 and 86 respectively, disposed rearwardly from the forward edge 88 of the carrier. Each of the recesses 84 and 86 is interrupted along its length by the slots 76.

The terminal carrier 74 carries an array of insulation displacement terminals each comprising a pair of contact arms 90 which extend from within the carrier 74 and projects forwardly into a respective slot 76. One of the arms 90 includes a preload projection 92 which engages the other arm to spring the arms slightly apart, and a strain relief projection 94 which is located forward of the preload projection and which projects towards the other arm 90. Each arm also includes a cutting edge 96 at its forward end adjacent the cutting edge of the opposite arm. The arms 90 may be resiliently deflected in opposite lateral directions within the terminal carrier so as normally to accommodate an insulated conductor wire 98 between them.

Figure 12:
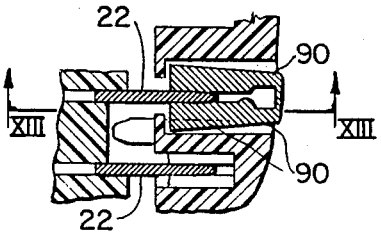
FIG. 12 is a cross-sectional view of a connector of the first embodiment mounted into the cross-connect connector.
Figure 13:
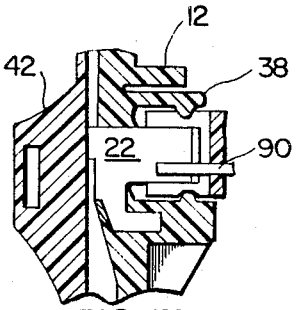
FIG. 13 is a cross-sectional view taken along line XII—XII in FIG. 12.

However, it is intended that the patch cord of the embodiment is to be used as a replacement for the conventional conductor wire 98. The patch cord is to extend between two terminal assemblies 72 with the connectors connected to chosen terminals of each terminal assembly. FIGS. 12 and 13 illustrate the manner in which each connector is mounted into its respective terminals. To enable each connector 10 to be connected into the terminals of its associated terminal assembly 72, the forward edge 88 of the carrier 74 is inserted into the recess 34 in the connector by movement of the connector onto the carrier. This moves the respective contact blade 22 into a position between a pair of contact arms 90 of one terminal so that the blades 22 are connected with adjacent terminals as shown by FIG. 13. At the same time, the latches are resiliently flexed by engagement with one of the upper surfaces 80 and 82 of the carrier so that each latch moves towards its chain-dotted position shown in FIG. 2. When the connector 10 reaches its correct mounting position with each blade 22 electrically engaged with its respective insulation displacement terminal, then the head 40 of the latch 38 is engaged with the recess 84 or 86 in the carrier and the projection 36 is engaged on the other side of the carrier in the other recess 84 or 86. This is shown by FIG. 13. As can be seen, it is then a simple matter to remove each connector when this is necessary by merely pulling manually upon the cover 42. In the mounted position of the patch cord upon the terminal assemblies, there is no undue flexing or bending of the cable 58. This is because the cable is received in each connector transversely to the direction of extension of the contact blades 22 from the body 12 as the entrance to the chamber extends axially also in a direction transverse to the direction of projection of the contact blades.

Figure 14:
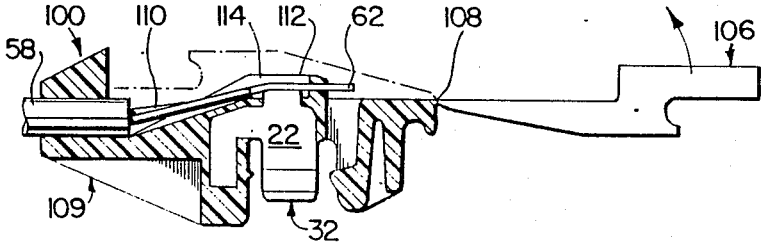
FIG. 14 is a view similar to FIG. 2 of an electrical connector forming part of a patch cord and according to a second embodiment.

In a second embodiment as shown by FIG. 14, a patch cord 100 has two connectors 102 (one only being shown). Each connector has a body 104 basically of the same construction as the body 12 in the first embodiment, but the connector differs from that of the first embodiment in that it has a cover 106 integrally formed with the body and which is hinged at one end at position 108 onto the body. In FIG. 14, the cover 106 is shown in full outline in a position removed from its final snap-on position so that the opening to a chamber 110 for the insulated conductors, the terminal position 112 and the strain relief opening 114 is accessible for insertion of the insulated conductors 62 of the cable 58. As may be seen from FIG. 14, when the conductors have been electrically soldered to the blades 22, then the cover may be hinged across the body into its chain-dotted position as a snap-fit between side walls 18 of the body whereby the cover is retained permanently in position.

In modifications of the embodiments (not shown) the conductor wires 62 may be assembled onto contact blades not only by solder as described above, but alternatively by receiving the conductor wires within insulation displacement terminals provided upon the contact blades or by a terminal screw.

WHAT IS CLAIMED IS:

1. An electrical connector for electrical connection to an insulation displacement terminal of a terminal assembly, the connector comprising:

a dielectric housing body having an integral latch means extending outwardly from one side of the body for releasably latching the connector in a mounting position on the terminal assembly, the housing body defining a chamber with an entrance to the chamber for an insulated conductor, a conductor terminal position within the body, an opening at another side of the body for access to the chamber and the terminal position, an electrical contact blade carried by and extending from said one side of the body, the contact blade also extending to the terminal position, and a conductor insulation strain relief means; and a cover for positioning over and closing the opening, the cover locatable to close the opening in a snap-on manner.

2. A connector according to claim 1 wherein the insulation strain relief means comprises an integral part of the body which forms a strain relief passage for the insulated conductor, the passage having an open side at said other side of the body to enable the insulated conductor to be passed into the passage and gripped by the body.

3. A connector according to claim 2 wherein the cover, when in position mounted upon the body, covers the open side to the strain relief passage to prevent lateral removal of the insulated conductor therefrom.

4. A connector according to claim 3 wherein the cover has an integral cable jacket strain relief element which, when the cover is mounted upon the body, projects into the chamber for gripping a cable to be passed through the entrance into the chamber, the cable including the insulated conductor.

5. A connector according to claim 1 wherein said one side and said other side of the body are opposite sides of the body.

6. A connector according to claim 5 wherein the cover has a cover portion and a manually grippable projecting portion which extends away from the body with the cover assembled to the body so as to enable the connector to be mounted in and released from its mounting position.

7. A connector according to claim 6 wherein the manually grippable projecting portion has sides which converge as they extend away from the cover portion.

8. A connector according to claim 1 wherein the electrical contact blade is molded into the body.

9. A connector according to claim 1 wherein the electrical contact blade is mounted in the body by passage of the blade through the opening to the terminal position so as to cause the blade to extend from the body, the blade having means to locate it in a desired operable position.

10. A connector according to claim 9 wherein the locating means holds the blade in its desired operable position and prevents blade removal.

11. A connector according to claim 1 wherein the cover, when in its snap-on position on the body, prevents removal of the blade from its desired operable position.

12. A connector according to claim 1 wherein the body and cover are integrally formed as a single member with the cover connected to the body by a hinge and the cover is movable from a position withdrawn from the opening to the chamber and terminal position to the snap-on position of the cover on the body.

13. A connector according to claim 1 wherein the contact blade extends from the body in one direction and the entrance to the chamber extends axially in a direction transverse to said one direction so that an insulated conductor extends into and across the chamber transversely to said one direction.

* * * * *